United States Patent [19]

Schumacher

[11] 4,444,210

[45] Apr. 24, 1984

[54] APPARATUS FOR RECIPROCATING THE ROD GUIDE IN THE CUTOFF OF A CIGARETTE ROD MAKING OR LIKE MACHINE

[75] Inventor: Peter Schumacher, Hamburg, Fed. Rep. of Germany

[73] Assignee: Hauni-Werke Körber & Co. KG., Hamburg, Fed. Rep. of Germany

[21] Appl. No.: 315,413

[22] Filed: Oct. 27, 1981

[30] Foreign Application Priority Data

Nov. 26, 1980 [DE] Fed. Rep. of Germany ..... 3044483

[51] Int. Cl.[3] ..... A24C 5/28

[52] U.S. Cl. ..... 131/84 R; 74/52; 131/65

[58] Field of Search ..... 131/84 R, 65, 84 A, 131/84 B, 84 C; 83/338; 74/781 R, 801, 802, 52

[56] References Cited

U.S. PATENT DOCUMENTS

| | | | |
|---|---|---|---|
| 1,203,481 | 10/1916 | Carlson | 74/52 |
| 2,166,975 | 7/1939 | Sologaistoa | 74/52 |
| 2,524,734 | 10/1950 | Pfau | 74/52 |
| 2,540,492 | 3/1952 | Bennett et al. | 74/52 |
| 3,140,632 | 7/1964 | Rowlands et al. | 131/65 |
| 3,476,002 | 11/1969 | Bardenhagen et al. | 131/65 |
| 3,760,672 | 9/1973 | Labee et al. | 131/65 |
| 4,089,228 | 5/1978 | Obra | 74/52 |

OTHER PUBLICATIONS

Product Engineering, "Mechanisms", vol. 30, pp. 66–67, Sep. 28, 1959.

*Primary Examiner*—Vincent Millin
*Assistant Examiner*—Harry J. Macey
*Attorney, Agent, or Firm*—Peter K. Kontler

[57] ABSTRACT

Apparatus for reciprocating the tubular rod guide which supports the cigarette rod during severing by the orbiting knife of a cutoff has a pair of identical drives whose first driving units receive rotary motion from a common driver gear and transmit torque to eccentrically mounted second driving units. The second driving units support an eccentrically mounted holder for the rod guide. The eccentricity of the second driving units with reference to the respective first driving units is the same as the eccentricity of the holder with reference to the second driving units. The RPM of the first driving units is half the RPM of the second driving units, and the first and second driving units of each drive rotate in opposite directions. Elastic cushions are interposed between the holder and each second driving unit.

9 Claims, 5 Drawing Figures

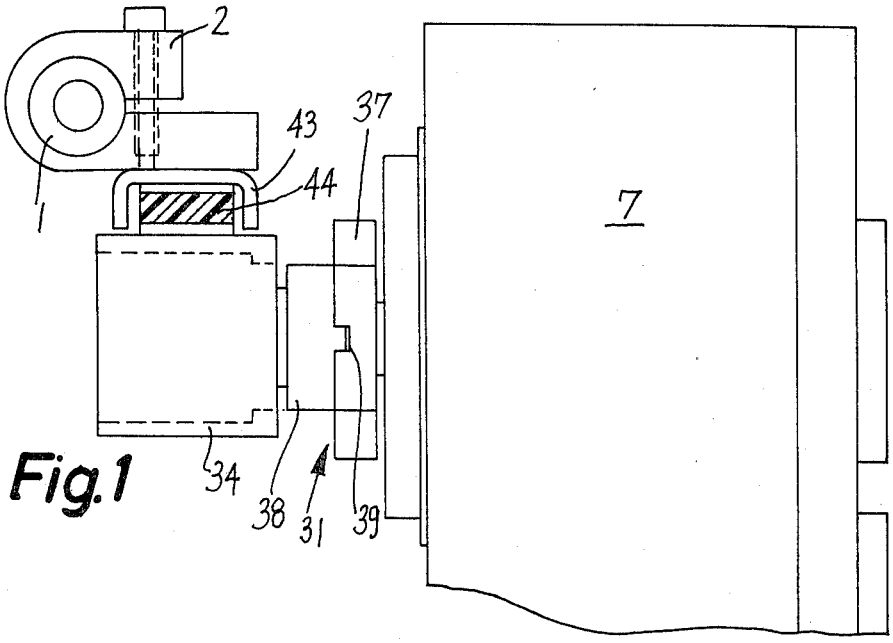
Fig.1
Fig. 5
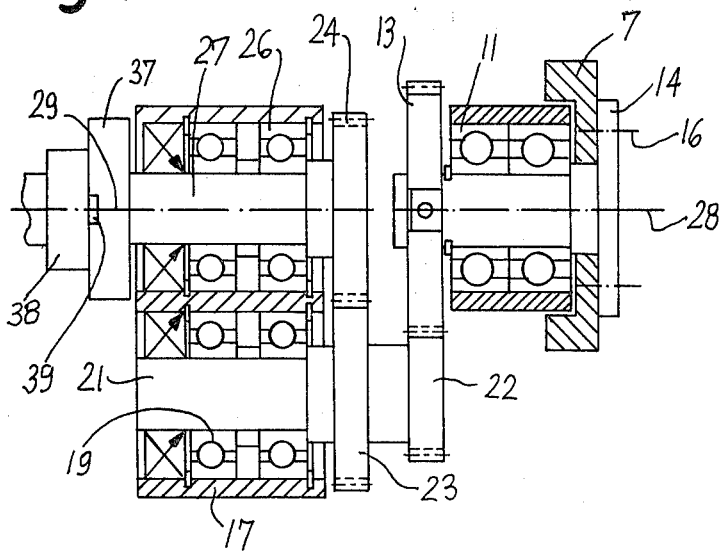

APPARATUS FOR RECIPROCATING THE ROD GUIDE IN THE CUTOFF OF A CIGARETTE ROD MAKING OR LIKE MACHINE

BACKGROUND OF THE INVENTION

The present invention relates to apparatus for severing elongated rod-shaped commodities, such as cigarette rods, filter rods or the like. More particularly, the invention relates to improvements in apparatus for reciprocating a device which is used in a rod severing apparatus (such severing apparatus are known as cutoffs) to guide, confine and support the rod during cutting by the knife or knives of the cutoff.

Cutoffs are used in cigarette rod making, filter rod making and like machines to sever a continuous rod at regular intervals so that the rod, which moves lengthwise, yields a succession of discrete rod-shaped articles constituting plain cigarettes, cigars or cigarillos or filter rod sections of unit length or multiple unit length. A cutoff of such character is disclosed, for example, in commonly owned U.S. Pat. No. 3,518,911 granted July 7, 1970 to Helmut Niemann et al. A guide is provided to confine the rod in the region of the knife and such guide serves to support the rod as well as to constitute a counterknife for the orbiting knife or knives of the cutoff. The guide must move back and forth, and is caused to advance forwardly in the direction of movement and at the speed of the rod while a knife performs its cutting stroke. The same holds true when the cutoff is used to sever a continuous filter rod or a continuous hollow cylindrical rod which is to yield a succession of tubes of the type often used in the making of certain types of filter mouthpieces. For the sake of simplicity, the following description will deal with the cutoffs and guides for cigarette rods but it will be readily understood that the invention can be embodied with equal advantage in cutoffs for rods which are to be subdivided into cigars, cigarillos or cheroots as well as in cutoffs which are used in filter rod making machines.

The cutoff is a highly important and very sensitive component of a cigarette rod making machine. Its knife or knives must sever the rod in a plane extending exactly at right angles to the axis of the rod, each cut must be clean and the rod must be properly confined, supported and guided in the region of the severing station. Since a modern cigarette maker turns out in excess of 100 cigarettes per second, the guide must be caused to oscillate at a frequency of several thousand times per minute and in such a way that it invariably moves forwardly with and at the speed of the rod when a knife moves across the path of and thereby severs the rod. The speed of the rod is in the range of several hundred meters per minute. This means that the guide must be accelerated from a starting position to the exact speed of the rod, it must move at the speed of the rod during severing of the rod, it must be decelerated to zero speed, and it must move at a high speed and counter to the direction of movement of the rod back to its starting position several thousand times per minute. The guide has a narrow transversely extending slot through which the cutting edge of a knife moves in the course of the severing operation which, as explained above, takes place while the guide and the rod move in the same direction and at the same speed. The consistency of the rod is such that it cannot offer a satisfactory resistance to deformation in the course of a severing operation, i.e., the knife which approaches and penetrates into the rod at a frequency of several thousand times per minute would flex the rod in the absence of suitable means for holding the rod portion at the severing station against deformation, i.e., against flexing of the rod laterally of and away from the prescribed path wherein the rod advances axially under the action of the customary garniture in the cigarette rod making machine.

Heretofore known apparatus which are used to move the rod guide in the region of the cutoff back and forth at a frequency of several thousand times per minute exhibit a number of serious drawbacks. First of all, the mass of such apparatus is substantial with attendant application of enormous stresses to the bearings for as well as to the material of the guide and other elements which share or initiate the movements of the guide. Secondly, oscillatory movements of the guide at the aforementioned high frequency are accompanied by the generation of readily detectable noise which is bothersome to attendants. Still further, the inertia of moving parts is sufficiently high to prevent an increase of the oscillation frequency to a value which is required in a modern high-speed cigarette maker so that the maker must be operated at less than maximum capacity only because the guide for the rod in the cutoff of the cigarette maker cannot move back and forth at the rate at which the orbiting knife or knives of the cutoff are capable of severing the rod. In other words, the output of the entire machine is limited because the oscillation frequency of the rod guide cannot be increased to a value which is commensurate with maximum capacity of the cutoff and/or other component parts of the cigarette maker.

OBJECTS AND SUMMARY OF THE INVENTION

An object of the invention is to provide a novel and improved apparatus for reciprocating the rod guide in or at the cutoff of a cigarette rod making or an analogous machine.

Another object of the invention is to provide an apparatus which can reciprocate the rod guide at a frequency exceeding that of rod guides for heretofore known cutoffs and which can reciprocate the rod guide without subjecting the supporting means for the guide to excessive stresses.

A further object of the invention is to provide an apparatus which can be installed in or combined with existing cutoffs as a superior substitute for the apparatus of presently known design.

An additional object of the invention is to provide an apparatus which ensures quiet operation of the rod guide, which is at least as compact as heretofore known apparatus, and which can reciprocate the rod guide at a frequency that is commensurate with the capacity of the cutoff and/or other components of a rod making machine.

Still another object of the invention is to provide a lightweight apparatus which can stand long periods of uninterrupted use and which can guide the rod with a degree of accuracy at least matching that of heretofore known rod guides.

A further object of the invention is to provide novel and improved driving or motion transmitting units for use in an apparatus of the above outlined character.

An ancillary object of the invention is to provide novel and improved means for coupling the rod guide with an apparatus of the above outlined character.

Another object of the invention is to provide a rod guide and a reciprocating apparatus therefor which enable a cutoff to sever a continuously moving cigarette rod or the like at a frequency of more than 100 times per second without sacrificing the quality of the cutting operation and without the generation of detectable or excessive noise.

The invention is embodied in an apparatus which serves to reciprocate a device, known as a rod guide, which guides a continuous rod during lengthwise movement through the severing station of a machine for the making of rod-shaped smokers' products. The apparatus comprises at least one drive including a rotary first driving unit, means for rotating the driving unit in a first direction and at a first rotational speed, a second driving unit which is eccentric with reference to the first driving unit, means for rotating the second driving unit in a second direction counter to the first direction and at a second rotational speed which is twice the first speed, and means for eccentrically mounting the device on the second driving unit. The eccentricity of the device with reference to the second driving unit is identical with eccentricity of the second driving unit with reference to the first driving unit.

The apparatus preferably comprises two identical drives, and the mounting means can comprise a holder which is arranged to support the device and is operatively connected with the second driving units of both drives. Still further, the apparatus preferably comprises elastic cushioning means interposed between the holder and at least one of the second driving units (if the apparatus comprises two drives) or between the holder and the second driving unit of the single drive.

Each drive preferably further comprises a fixed sun gear and the first driving unit then comprises a rotary planet carrier which is coaxial with the sun gear. The second driving unit then comprises a planet pinion which is rotatably mounted in the planet carrier and meshes with the sun gear. The means for rotating the first driving unit comprises a driver gear, and the planet carrier comprises a further gear (e.g., a ring gear) which meshes with the driver gear so that the planet carrier rotates and causes the planet pinion to roll along the sun gear which constitutes the means for rotating the second driving unit.

In accordance with a presently preferred embodiment of the invention, the second driving unit further comprises a first shaft which is coaxial with and is driven by the planet pinion, a second shaft which is parallel with the first shaft, a transmission (preferably a gear transmission) having a ratio of one-to-one and arranged to rotate the second shaft in response to rotation of the first shaft, and a crank unit receiving motion from the second shaft and connected with the mounting means.

The crank unit preferably comprises means for varying the eccentricity of the mounting means with reference to the second shaft. To this end, the crank unit may comprise a crank arm having first and second portions which are movable relative to each other between a plurality of positions in each of which the eccentricity of the mounting means relative to the second shaft assumes a different value, and one or more screws, bolts or analogous means for securing the two portions of the crank arm to each other in selected positions.

Still further, the apparatus can comprise means for varying the eccentricity of the second driving unit with reference to the first driving unit; such eccentricity varying means can comprise a set of sleeve-like receptacles for second shafts, and a selected receptacle can be mounted in or on the planet carrier of the first driving unit in a position in which the axis of the second shaft, which is rotatably journalled in the selected receptacle, is disposed at one of several predetermined distances from the axis of the planet carrier.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 1 is an end elevational view of a device which constitutes a rod guide and a fragmentary end elevational view of a novel reciprocating apparatus therefor;

FIG. 5 is a vertical sectional view as seen in the direction of arrows from the line V—V of FIG. 3.

DESCRIPTION OF THE PREFERRED EMBODIMENTS

Figure 2:
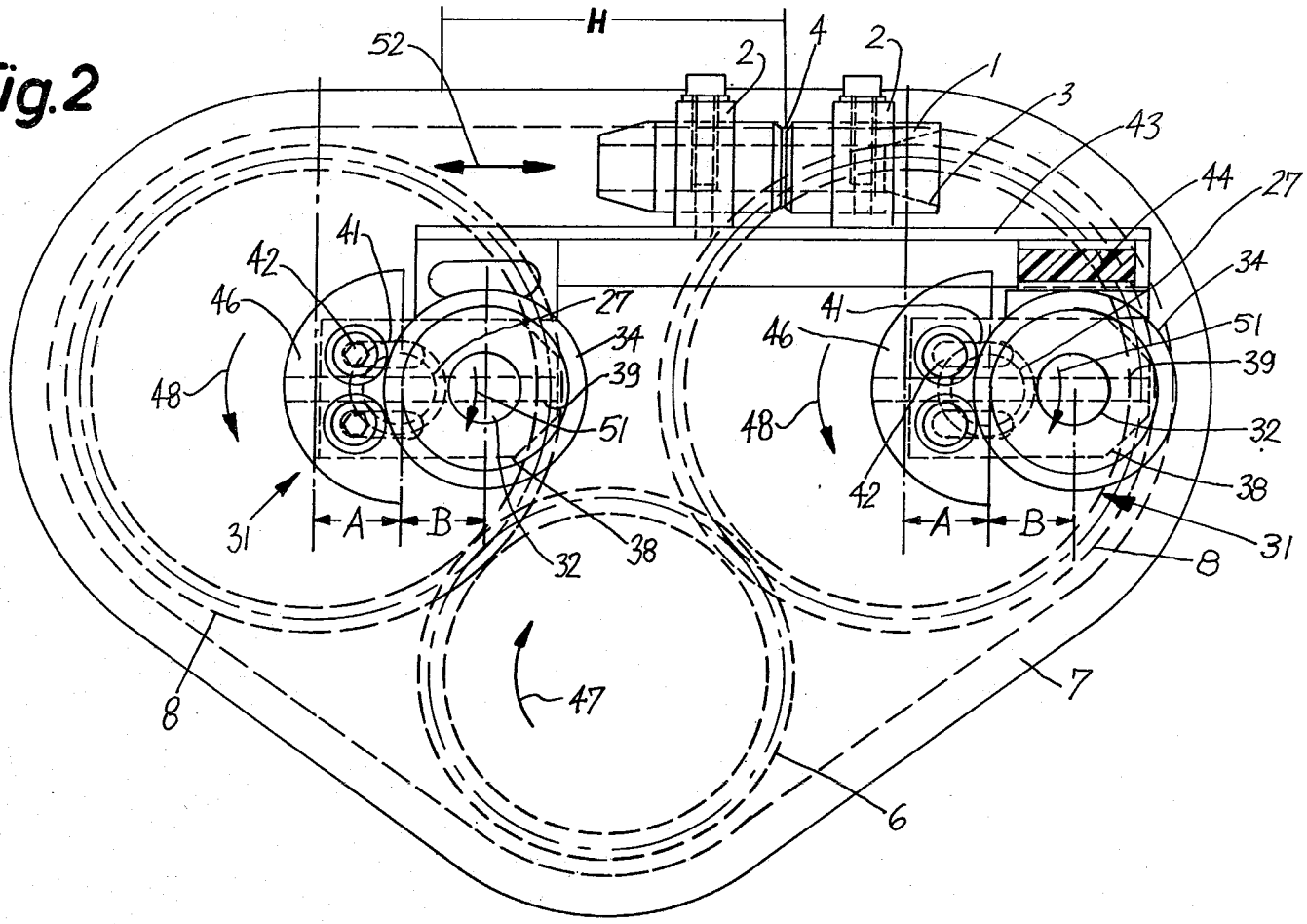
FIG. 2 is a front elevational view as seen from the left-hand side of FIG. 1, with a cushion for one end portion of the holder means for the guide shown in a vertical sectional view.

Referring first to FIGS. 1 and 2, the rod guide 1 is an elongated tubular device which has an axial passage for a continuous cigarette rod, not shown. The cigarette rod making machine in which the structure of FIGS. 1 and 2 is installed may be of the type known as SE 80 Iwhich is manufactured and sold by the assignee of the present application. The rod guide 1 is mounted in two clamping devices 2 which are spaced apart from each other, as considered in the axial direction of the guide, and the rear end portion of the guide has a frustoconical inlet 3 which allows for convenient threading of the leader of a cigarette rod into the axial passage of the guide. The central portion of the guide 1 has a transversely extending slot 4 through which a knife of the cutoff advances in the course of a severing operation. As mentioned above, a cutoff which can be used with the rod guide 1 and with the improved apparatus for reciprocating the guide is disclosed in the commonly owned U.S. Pat. No. 3,518,911 to Niemann et al.

The apparatus which reciprocates the guide 1 comprises a single drive gear 6 which transmits torque to a pair of ring gears 8 each forming part of a discrete drive. The major parts of the two drives are installed in a common housing 7 which is adjacent to the rod guide 1. Since the two drives are identical, the following description will deal with the details of one of the drives; the other drive will be referred to only in order to point out the differences (if any) between the two drives and/or the mode of operation of the improved reciprocating apparatus.

The ring gear 8 forms part of a planet carrier 9 which is rotatably mounted in the housing 7 on antifriction ball bearings 12 and constitutes or forms part of the first driving unit of the respective drive. The shaft 13*a* of a sun gear 13 is surrounded by antifriction ball bearings 11 in the planet carrier 9 and extends from the housing 7. The outer end portion of the shaft 13*a* carries a flange 14 which is non-rotatably secured to the housing 7 by at least one set of screws 16 or analogous fasteners.

Figure 3:
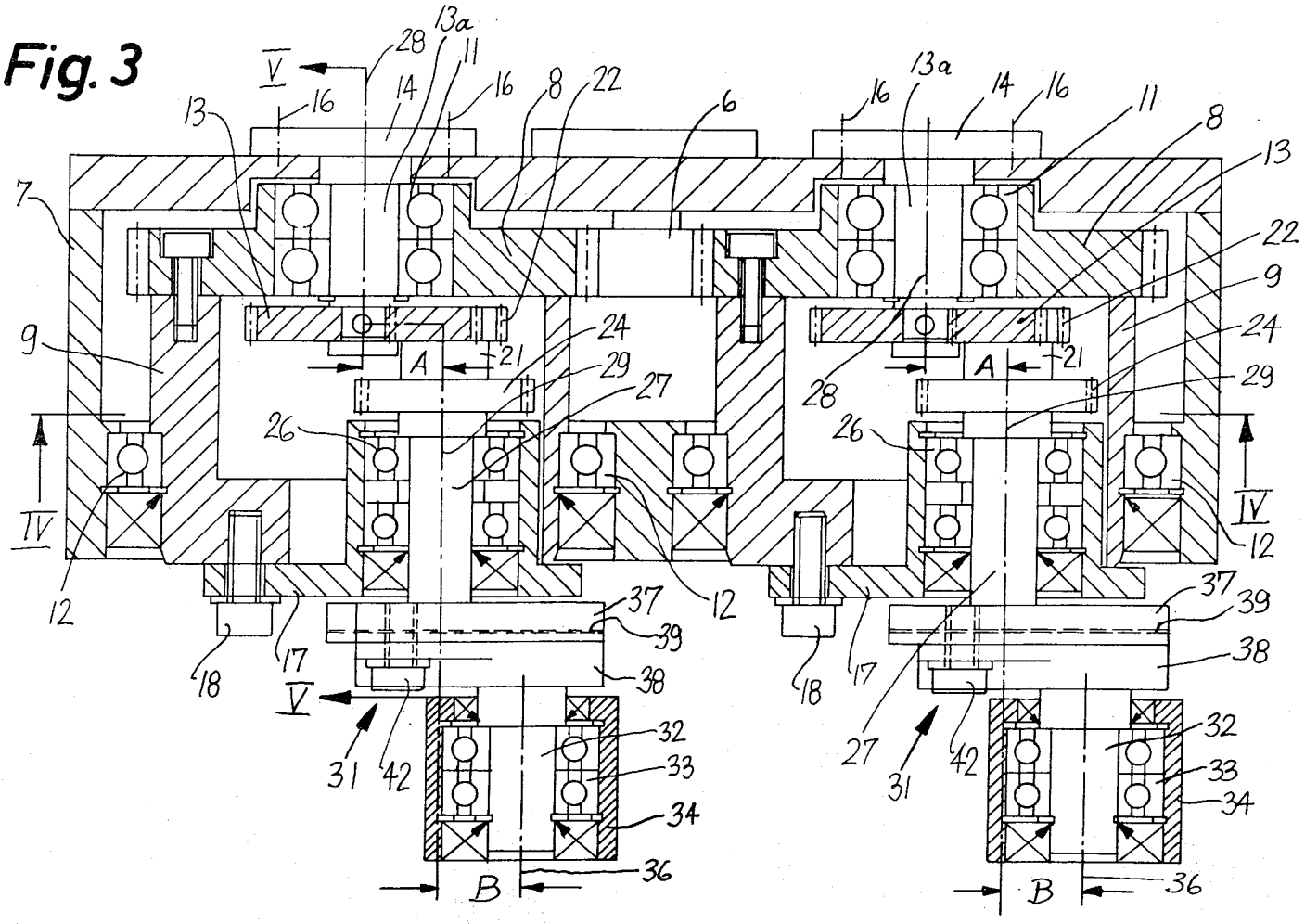
FIG. 3 is a horizontal sectional view of the apparatus.
Figure 4:
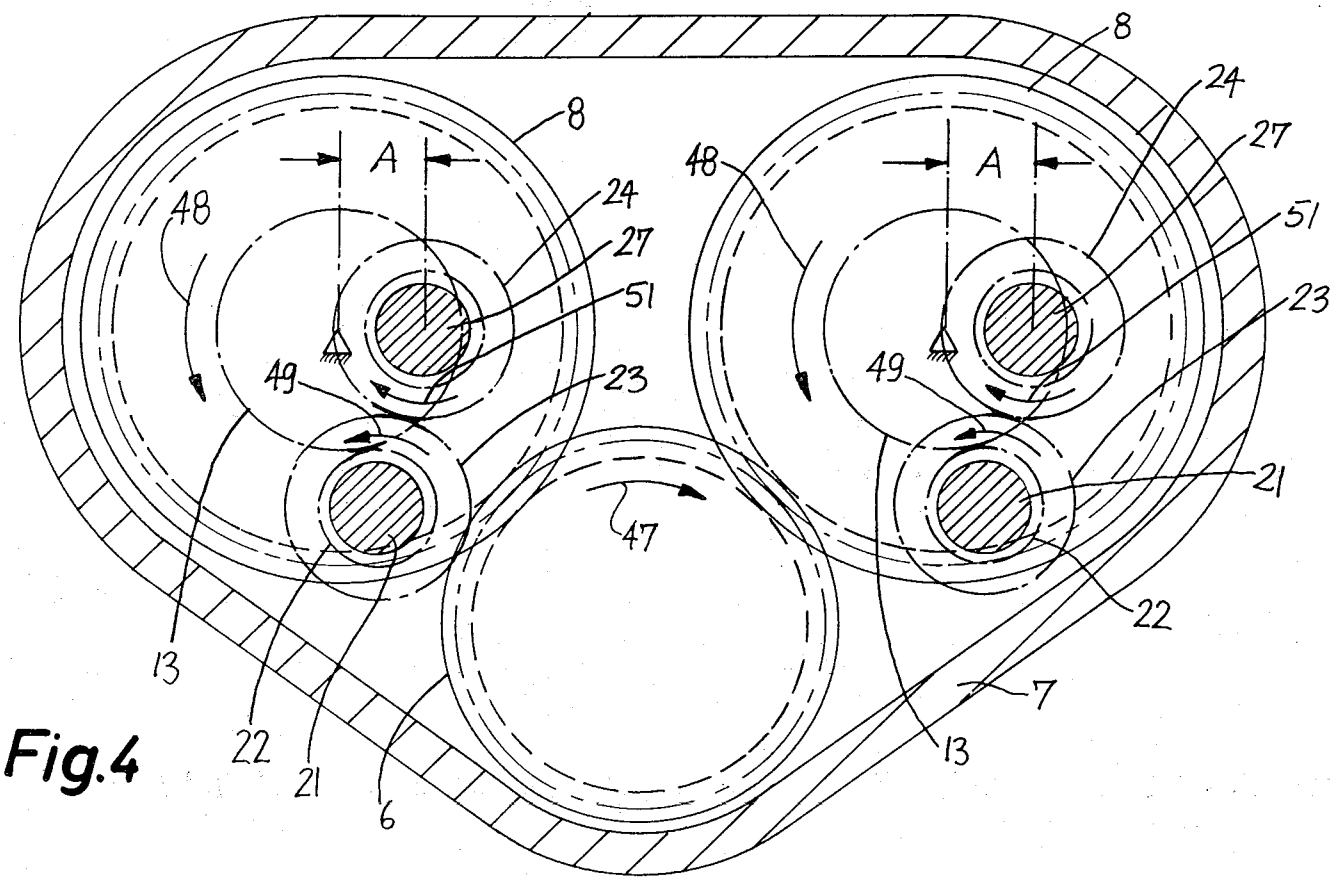
FIG. 4 is a vertical sectional view as seen in the direction of arrows from the line IV—IV of FIG. 3.

The planet carrier 9 is rigidly but separably connected with a sleeve-like receptacle 17 for a second driving unit. The receptacle 17 is separably connected to the planet carrier 9 by one or more bolts 18, screws or analogous securing means; this receptacle is replaced with a different receptacle when the apparatus is to be converted to reciprocate the guide 1 during severing of longer or shorter rod sections. As can be seen in FIG. 5, the sleeve-like receptacle 17 contains antifriction ball bearings 19 for a first shaft or input shaft 21 carrying a planet pinion 22 which is in mesh with and is rotated by the stationary sun gear 13 when the gear 6 drives the planet carrier 9. The pinion 22 forms part of a second driving unit of the respective drive. The transmission ratio between the sun gear 13 and planet pinion 22 equals one-to-two. The shaft 21 is rigidly connected with a gear 23 forming part of a gear transmission which further includes a gear 24 on a rotary second or output shaft 27 of the second driving unit. The transmission ratio of the gears 23 and 24 is one-to-one. The output shaft 27 is rotatable in antifriction ball bearings 26 which are installed in the receptacle 17. As can be readily seen in FIGS. 2, 3 and 4, the common axis 29 of the gear 24 and output shaft 27 is eccentric with reference to the common axis 28 of the planet carrier 9 and sun gear 13; the eccentricity is indicated at A.

One end portion of the output shaft 27 extends from the housing 7 and carries a crank unit 31 having a crank pin 32 for a set of antifriction ball bearings 33 surrounded by a bearing sleeve 34. The eccentricity B of the axis 29 with reference to the common axis 36 of the crank pin 32 and bearing sleeve 34 matches the aforediscussed eccentricity A.

In order to allow for convenient changes in the length of rod sections which are to be separated from the continuously advancing cigarette rod, the crank arm of the crank drive 31 comprises two portions or cheeks 37, 38 which are provided with complementary faces, as at 39, allowing the cheek 37 to move relative to the cheek 38 (or vice versa) between a plurality of positions in order to change the extent of eccentricity B. The means for separably coupling the cheeks 37, 38 to each other comprises a bolt 42 which extends through aligned elongated slots 41 of the two cheeks. When the bolt 42 is loosened, the cheek 38 can be shifted relative to the cheek 37 in the direction which is determined by the guide means including the complementary faces 39 of the two cheeks so that the person in charge can change the eccentricity B. The eccentricity A is changed in the aforediscussed manner, i.e., by replacing the receptacle 17 with a different receptacle for a shaft 27 whose axis (29) is offset to a predetermined extent with reference to the common axis 28 of the sun gear 13 and planet carrier 9.

The two crank drives 31 are located externally of the housing 7 and together constitute a parallel crank transmission whose bearing sleeves 34 carry an elongated inverted U-shaped mounting means or holder 43 for the clamping devices 2. The holder 43 is secured to the bearing sleeves 34 of the two crank drives by interposition of elastic cushioning inserts 44 each of which is bonded or otherwise secured to the holder 43 on the one hand and to the respective bearing sleeve 34 on the other hand. The clamping devices 2 are rigid with the intermediate portion of the holder 43. The reference characters 46 denote counterweights for unbalanced masses of the crank drives 31.

The improved apparatus could be provided with a single drive, i.e., with a single planet carrier 9, a single sun gear 13, a single gear transmission 23, 24 and a single crank unit 31. The provision of two identical drives which are operated in synchronism with each other is preferred because they further reduce the likelihood of changes in orientation of the holder 43 and rod guide 1 when the apparatus is in actual use. The axis of the guide 1 is horizontal because the path along which the cigarette rod advances in a rod making machine is normally horizontal; however, the orientation of the guide 1 can be selected at will, and such orientation thereupon remains unchanged during each and every stage of each oscillatory movement of the rod guide. Moreover, the provision of two drives which operate in synchronism with each other renders it possible to employ a lightweight holder 43 whose inertia is small or negligible and which can be secured to the two crank drives in a very simple but reliable way. The elastic cushioning inserts 44 compensate for manufacturing tolerances (if any) as well as for lack of highly accurate adjustment of certain parts (e.g., proper synchronization of movements of the component parts of the two drives). Thus, by the simple expedient of installing elastic cushioning means between the holder 43 and the bearing sleeves 34, one can compensate for or eliminate any and all tolerances and/or other inaccuracies. For example, such cushioning inserts can compensate for minor deviations of dimensions of component parts of one drive from the dimensions of corresponding component parts in the other drive.

The provision of stationary sun gears 13 which are surrounded by rotary planet carriers 9 and mate with planet pinions 22 mounted in the respective planet carriers contributes to compactness and simplicity of the drives. Furthermore, such drives can be encapsulated in a common housing. The planet carriers 9 and the planet pinions 22 perform rotary movements; this contributes to a reduction or elimination of noise and to surprisingly quiet and smooth operation of the improved apparatus.

The operation is as follows:

The driver gear 6 is driven (see the arrow 47) by the motor, not shown, which orbits the knife or knives of the cutoff. The gear 6 transmits torque to the two planet carriers 9 through the medium of their ring gears 8 so that the planet carriers rotate counter to the direction of rotation of the gear 6 (note the arrows 48 in FIG. 4). The planet pinions 22 (which are mounted in the respective planet carriers 9) roll along the associated sun gears 13 and thereby rotate about their axes (note the arrows 49 in FIG. 4) at a ratio of 2:1 with reference to the RPM of the planet carriers. The gears 23 are driven by the shafts 21 and rotate the associated gears 24 at the ratio of 1:1. The directions in which the gears 24 rotate are indicated by the arrows 51 shown in FIG. 4, i.e., the gears 24 rotate counter to the direction of rotation of the associated planet carriers 9 (arrows 48) and planet pinions 22 (arrows 49). The gears 24 transmit torque to the corresponding crank units 31 so that the two bearing sleeves 34 orbit about the respective axes 29, i.e., the axes 36 of the crank pins 32 travel along circular paths and about the axes 29 of the corresponding output shafts 27, and the radii of such circular paths equal B. The speed of orbital movement of crank pins 32 and their bearing sleeves 34 is twice the RPM of the respective planet carriers 9. Since each of the eccentricities B matches the respective eccentricity A, the bearing sleeves 34 maintain the holder 43 at a given level (i.e., the holder 43 does not move up or down but merely preforms a reciprocatory movement in directions indicated in FIG. 2 by the arrow 52). The length of forward and return strokes of the holder 43 (and hence of the guide 1) is shown in FIG. 2, as at H. The arrangement is such that, while the axis 29 of a driven shaft 27 moves from the twelve o'clock position toward the six o'clock position in the direction of arrow 48, the corresponding crank pin 32 moves from the six o'clock position toward the twelve o'clock position in the direction of arrow 51. Therefore, the level of the holder 43 remains unchanged. The movements of the two shafts 27 about the respective axes 28 and the movements of crank pins 32 about the respective axes 29 are synchronized so that the crank pins 32 rise with reference to the respective axes 29 and the axes 29 descend with reference to the respective axes 28 to the same extent which ensures that the orientation of the holder 43 remains unchanged, i.e., that the axis of the guide 1 invariably coincides with the axis of the cigarette rod which extends therethrough.

An important advantage of the improved apparatus is that the orientation of the rod guide 1 remains unchanged irrespective of the frequency at which the rod is severed. Secondly, the apparatus can be readily adjusted so as to change the throw of the crank pins 32 and hence the length (H) of forward and return strokes of the holder 43 and guide 1. The latter constitutes a tube so that it properly guides the cigarette rod in the course of each severing operation, i.e., while a cutting edge penetrates into and travels through the slot 4. The radial clearance between the internal surface of the guide 1 and the external surface of the cigarette rod can be kept to a minimum because the level of the holder 43 is constant, i.e., the guide does not move transversely of the advancing rod.

An additional important advantage of the improved apparatus is that it can be provided with very simple means for completely or practically completely compensating for unbalanced masses so that the operation of the apparatus is practically noiseless or, at the very least, much quieter than that of heretofore known apparatus. Such noiseless or quiet operation is attributed to the absence or nearly complete absence of vibrations even though the apparatus can reciprocate the rod guide 1 at a frequency which is in the range of or even appreciably exceeds 100 forward and 100 return strokes per second. Those masses which remain uncompensated are so small that they can be neglected without affecting the operation of the improved apparatus. The component parts of the apparatus can be made of lightweight metallic and/or plastic material so that the inertia of parts which must change the direction of their movement at a frequency of several thousand per minute is relatively small. It has been found that, even though the improved apparatus allows for a substantial increase of the output of a cigarette making or like machine, the quality of cuts which are performed by the knife or knives of the cutoff is not affected by such higher frequency.

Still another important advantage of the improved apparatus is that it can be rapidly converted for the severing of relatively long or shorter rod sections. All that is necessary is to replace the receptacles 17 with spare receptacles wherein the axes (29) of the output shafts 27 are located at a different distance from the axes (28) of the respective input shafts 21, and to change the effective length of the crank arms including the cheeks 37, 38.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. Apparatus for guiding a continuous rod during lengthwise movement through the severing station of a machine for the making of rod-shaped smokers' products, comprising a device which guides the rod during said lengthwise movement; identical first and second drives each including a rotary first driving unit, means for rotating said first unit in a first direction and at a first rotational speed, a second driving unit eccentrically mounted on said first unit, means for rotating said second unit in a second direction counter to said first direction and at a second speed twice said first speed; means for mounting said device, said mounting means being eccentrically installed on said second driving units and the eccentricity of said mounting means with reference to said second units being identical with the eccentricity of each second unit with reference to the respective first unit; and elastic cushioning means interposed between said mounting means and at least one of said second driving units.

2. The apparatus of claim 1, wherein said mounting means comprises a holder arranged to support said device and operatively connected with the second driving units of said drives.

3. The apparatus of claim 1, wherein each of said drives further comprises a fixed sun gear and each first driving unit comprises a rotary planet carrier coaxial with the respective sun gear, each second driving unit including a planet pinion mounted in the respective carrier and meshing with the respective sun gear.

4. The apparatus of claim 3, wherein said means for rotating said first units comprises a driver gear and each of said carriers includes a further gear meshing with said driver gear.

5. The apparatus of claim 1, wherein each second driving unit further comprises a first shaft coaxial with and driven by the respective pinion, a second shaft, and a transmission having a ratio of one-to-one and arranged to rotate said second shaft in response to rotation of said first shaft, said mounting means comprising two crank units each receiving motion from the respective second shaft and a holder for said device, said holder being connected with said crank units.

6. The apparatus of claim 5, wherein each of said transmissions includes mating gears on the respective shafts.

7. The apparatus of claim 5, wherein each of said crank units includes means for varying its eccentricity with reference to the respective second shaft.

8. The apparatus of claim 5, wherein each of said crank units comprises a crank arm having first and second portions movable relative to each other between a plurality of positions and means for coupling said portions to each other in selected positions, the eccentricity of said crank units with reference to the respective second units being adjustable in response to movement of said portions of the respective crank units to different positions relative to each other.

9. The apparatus of claim 1, further comprising means for varying the eccentricity of one of said units with reference to the other of said units in each of said drives.

* * * * *